US009404510B2

(12) United States Patent
Zhu et al.

(10) Patent No.: US 9,404,510 B2
(45) Date of Patent: Aug. 2, 2016

(54) FAN VIBRATION ABSORPTION STRUCTURE

(71) Applicant: ASIA VITAL COMPONENTS (CHINA) CO., LTD., Shenzhen (CN)

(72) Inventors: Pei-Su Zhu, Shenzhen (CN); Mao-Lin Chen, Shenzhen (TW)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 764 days.

(21) Appl. No.: 13/747,360

(22) Filed: Jan. 22, 2013

(65) Prior Publication Data

US 2014/0205437 A1 Jul. 24, 2014

(51) Int. Cl.

| | |
|---|---|
| ***F04D 29/52*** | (2006.01) |
| ***F04D 29/64*** | (2006.01) |
| ***F04D 29/66*** | (2006.01) |
| ***F04D 19/00*** | (2006.01) |
| ***F04D 29/60*** | (2006.01) |

(52) U.S. Cl.

CPC ..... *F04D 29/668* (2013.01); *F04D 19/007* (2013.01); *F04D 29/522* (2013.01); *F04D 29/601* (2013.01); *F04D 29/644* (2013.01)

(58) Field of Classification Search

CPC ... F04D 19/007; F04D 29/522; F04D 29/601; F04D 29/602; F04D 29/603; F04D 29/644; F04D 29/646; F04D 29/668; H05K 7/20136; H05K 7/20172; H05K 7/20145

USPC ..... 361/694, 695

See application file for complete search history.

(56) References Cited

U.S. PATENT DOCUMENTS 7,522,415 B2 * 4/2009 Fan ..... F04D 29/601 312/236
8,379,387 B2 * 2/2013 Chuang ..... H05K 7/20172 361/690
8,449,251 B2 * 5/2013 Lu ..... F04D 25/0613 415/213.1
8,613,588 B2 * 12/2013 Chen ..... F04D 29/601 415/119
8,649,172 B2 * 2/2014 Kuo ..... G06F 1/20 361/679.47
8,939,723 B2 * 1/2015 Kuo ..... H05K 7/20172 415/119
2007/0154300 A1 * 7/2007 Liang ..... F04D 25/166 415/119
2008/0043430 A1 * 2/2008 Chen ..... H05K 7/20172 361/679.34
2009/0057524 A1 * 3/2009 Chen ..... H05K 7/20172 248/638
2014/0178222 A1 * 6/2014 Hou ..... F04D 25/0613 417/423.15
2014/0205437 A1 * 7/2014 Zhu ..... F04D 29/668 415/119
2014/0252197 A1 * 9/2014 Doglio ..... H05K 7/20172 248/562
2015/0233387 A1 * 8/2015 Liu ..... F04D 29/644 29/889.3

* cited by examiner

*Primary Examiner* — Igor Kershteyn
*Assistant Examiner* — Christopher R Legendre

(57) ABSTRACT

A fan vibration absorption structure applied to a fan set having a first side and a second side respectively having multiple first and second fixing holes. The fan vibration absorption structure includes: a housing for receiving the fan set; a first frame body having multiple first through holes on the first side without contacting therewith, a first gap being defined between the first frame body and the first side, the first frame body having multiple first locating sections each having a first perforation, a second gap being defined between the first locating section and the housing; multiple first assembling member each having a first engagement section clamped between the first frame body and the first side to form the first gap; and multiple second assembling members each having a second engagement section clamped between the first locating section and the housing to form the second gap.

18 Claims, 10 Drawing Sheets

FAN VIBRATION ABSORPTION STRUCTURE

BACKGROUND OF THE INVENTION

1. Field of the Invention

The present invention relates generally to a fan vibration absorption structure, and more particularly to a fan vibration absorption structure, which is able to provide a much better vibration absorption effect and facilitate the assembling process of the fan.

2. Description of the Related Art

Along with the continuous advance of sciences and technologies, the reliance of peoples on various electronic apparatuses has more and more increased. In operation, the internal components of the electronic products (such as computers and laptops) will generate high heat. The heat must be dissipated to outer side of the electronic products in time. Otherwise, the problem of overheating will take place. Therefore, most of the electronic products are provided with fans disposed therein for keeping the electronic products working at an operation temperature within a range.

Currently, the conventional fan is generally installed on the case of the computer by means of screws. In operation, the fan will vibrate. At this time, the case of the computer will vibrate along with the fan. As a result, the case of the computer will make noise due to resonance. In some more serious cases, the vibration of the case will interfere with the normal work of the electronic components in the case. The existent fan vibration absorption structure has numerous assembling members, which are hard to manufacture. Moreover, the assembling members for fixing the fan on the case are made of such a material that the vibration of the fan can be hardly prevented from being transmitted to the case.

According to the above, the conventional technique has the following shortcomings:

1. The vibration absorption effect is poor.
2. It is hard to assemble the components.

SUMMARY OF THE INVENTION

It is therefore a primary object of the present invention to provide a fan vibration absorption structure, which is able to provide a much better vibration absorption effect.

It is a further object of the present invention to provide the above fan vibration absorption structure, which is able to facilitate the assembling process of the fan.

To achieve the above and other objects, the fan vibration absorption structure of the present invention is applied to a fan set having a first side and a second side opposite to the first side. The first side has multiple first fixing holes, while the second side has multiple second fixing holes. The fan vibration absorption structure includes a housing, a first frame body, multiple first assembling members and multiple second assembling members. The housing has a bottom board and two sidewalls disposed on two opposite sides of the bottom board. The bottom board and the sidewalls together define a receiving space for receiving the fan set. The first frame body is disposed on the first side of the fan set without contacting the first side. A first gap is defined between the first frame body and the first side. The first frame body has multiple first through holes corresponding to the first fixing holes. The first frame body further has multiple first locating sections protruding from the first frame body in a direction away from the first side of the fan set. The first locating sections correspond to the housing without contacting the housing. Each first locating section has a first perforation. A second gap is defined between the first locating section and the housing.

The first and second gaps communicate with the receiving space. The first assembling members are passed through the first through holes and the first fixing holes. Each first assembling member has a first engagement section clamped between the first frame body and the first side to form the first gap. The second assembling members are disposed on inner side of the housing. Each second assembling member has a second engagement section clamped between the first locating section and the housing to form the second gap.

According to the above fan vibration absorption structure, the first engagement section is clamped between the first frame body and the first side to form the first gap. Also, the second engagement section is clamped between the first locating section and the housing to form the second gap. Therefore, the first frame body is not in contact with the first side of the fan set and the first locating sections are not in contact with the housing. Accordingly, the vibration of the fan set is prevented from being transmitted to the housing. Therefore, the vibration absorption effect is greatly enhanced and the assembling process is facilitated

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
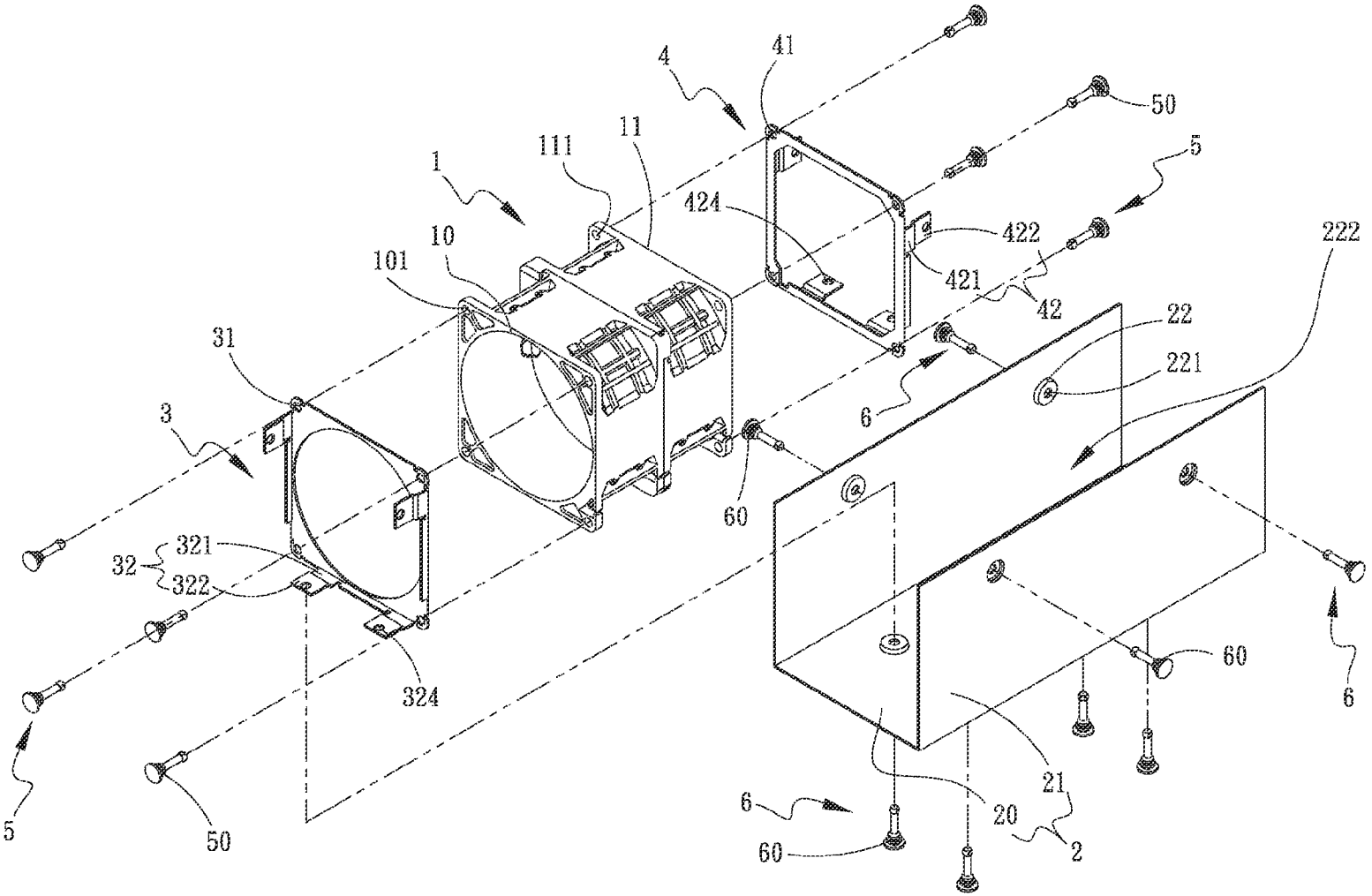
FIG. 1A is a perspective exploded view of a first embodiment of the fan vibration absorption structure of the present invention.
Figure 1B:
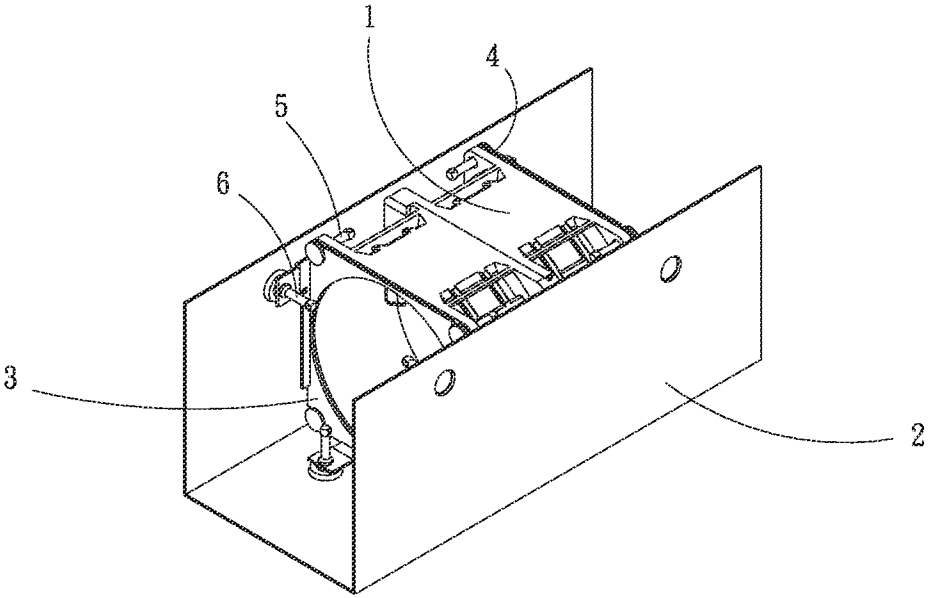
FIG. 1B is a perspective assembled view of the first embodiment of the fan vibration absorption structure of the present invention.

Please refer to FIGS. 1A and 1B. FIG. 1A is a perspective exploded view of a first embodiment of the fan vibration absorption structure of the present invention. FIG. 1B is a perspective assembled view of the first embodiment of the fan vibration absorption structure of the present invention. According to the first embodiment, the fan vibration absorption structure of the present invention is applied to a fan set 1 having a first side 10 and a second side 11 opposite to the first side 10. The first side 10 has multiple first fixing holes 101, while the second side 11 has multiple second fixing holes 111. The fan vibration absorption structure includes a housing 2, a first frame body 3, multiple first assembling members 5 and multiple second assembling members 6. The housing 2 has a bottom board 20 and two sidewalls 21 disposed on two opposite sides of the bottom board 20. The bottom board 20 and the sidewalls 21 together define a receiving space 222 for receiving the fan set 1. The first and second assembling members 5, 6 are made of thermoplastic elastomer material.

Figure 2A:
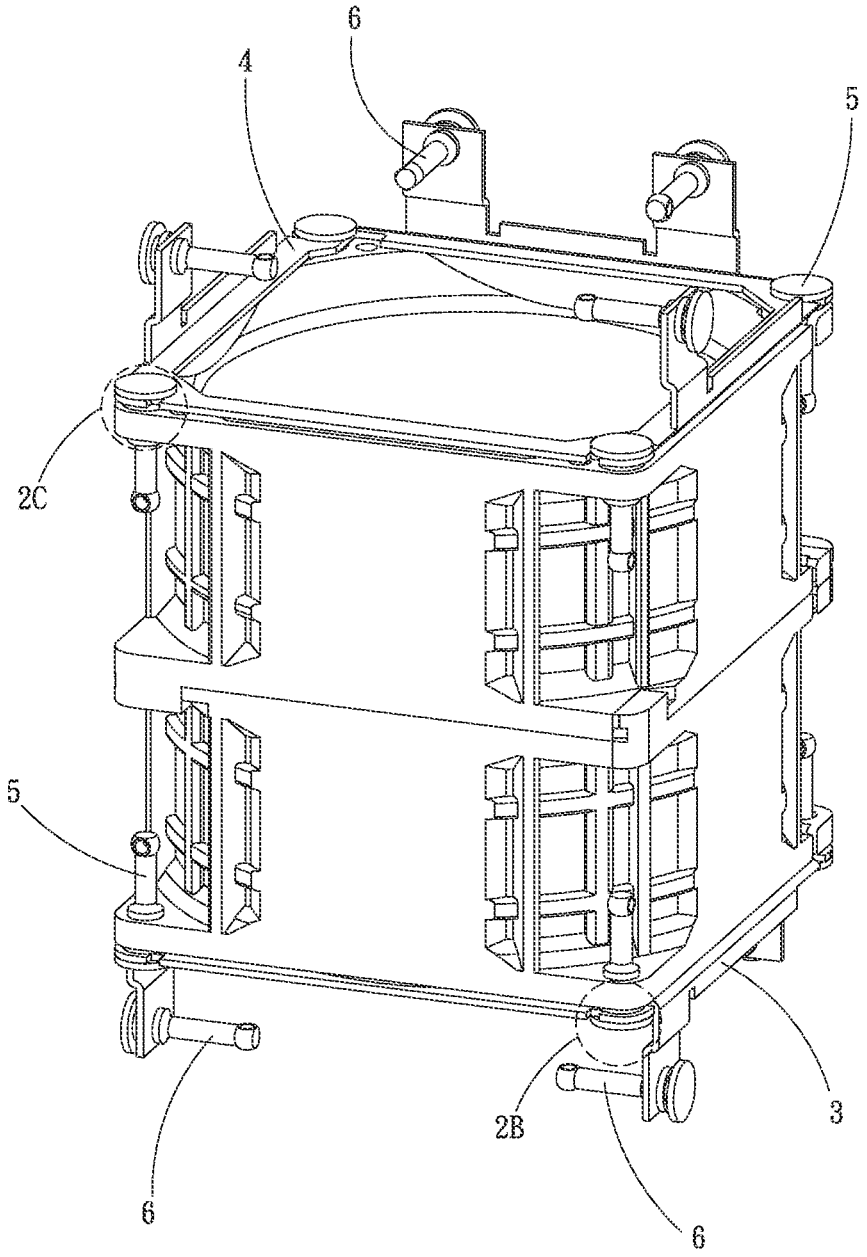
FIG. 2A is a perspective assembled view of the first embodiment of the fan vibration absorption structure of the present invention.
Figure 2B:
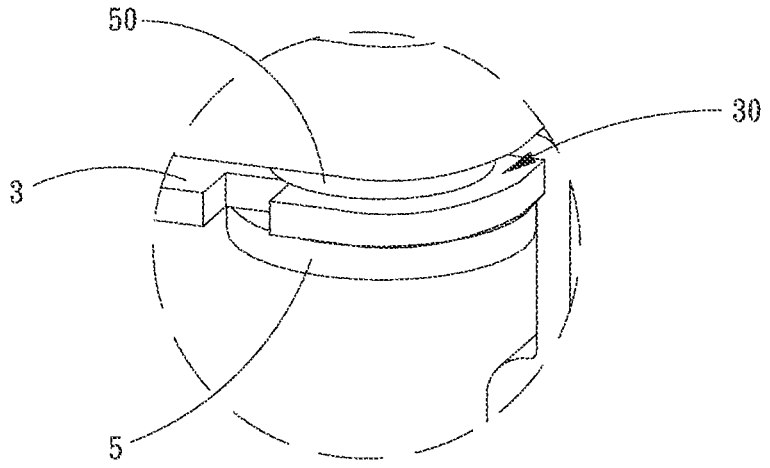
FIG. 2B is an enlarged view of circled area 2B of FIG. 2A.
Figure 3A:
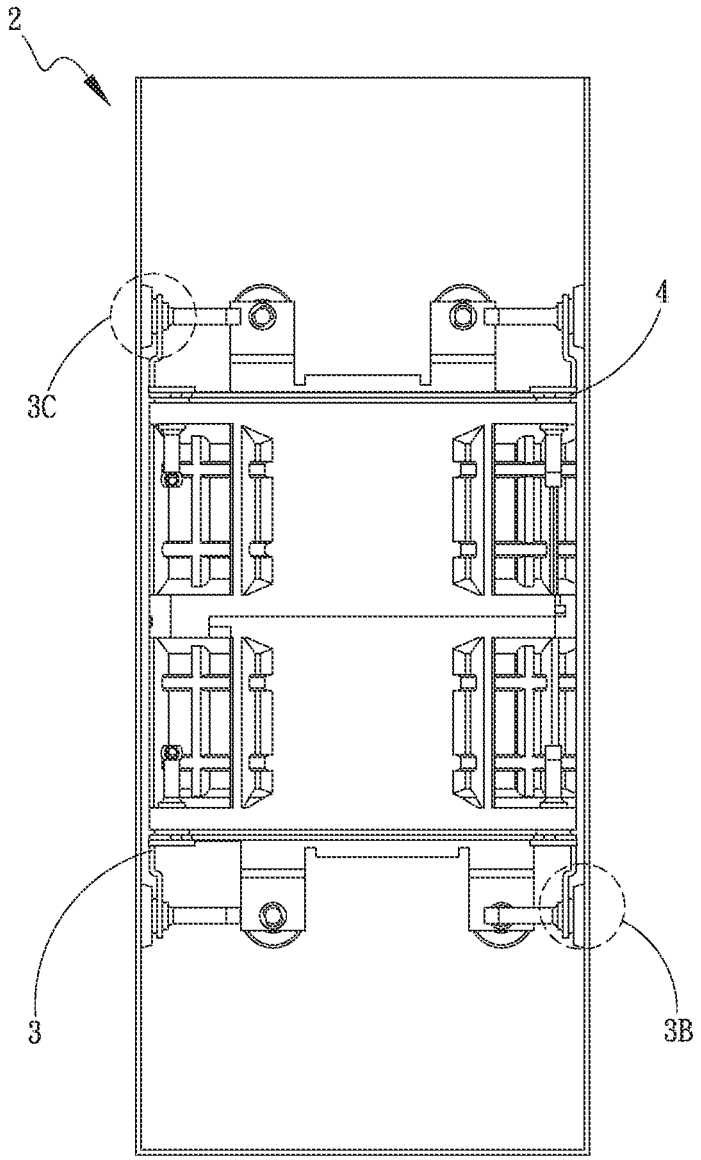
FIG. 3A is a plane assembled view of the first embodiment of the fan vibration absorption structure of the present invention.
Figure 3B:
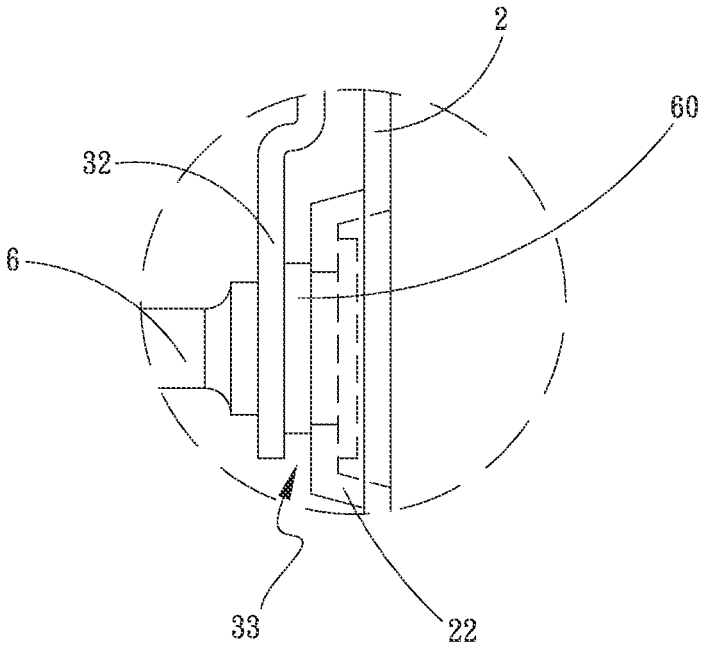
FIG. 3B is an enlarged view of circled area 3B of FIG. 3A.

Please now refer to FIGS. 2A, 2B, 3A and 3B. FIG. 2A is a perspective assembled view of the first embodiment of the fan vibration absorption structure of the present invention. FIG. 2B is an enlarged view of circled area 2B of FIG. 2A. FIG. 3A is a plane assembled view of the first embodiment of the fan vibration absorption structure of the present invention. FIG. 3B is an enlarged view of circled area 3B of FIG. 3A. The first frame body 3 is disposed on the first side 10 of the fan set 1 without contacting the first side 10. A first gap 30 is defined between the first frame body 3 and the first side 10. The first frame body 3 has multiple first through holes 31 corresponding to the first fixing holes 101. The first frame body 3 further has multiple first locating sections 32 protruding from the first frame body 3 in a direction away from the first side 10 of the fan set 1. The first locating sections 32 correspond to the housing 2 without contacting the housing 2. Each first locating section 32 has a first perforation 324. A second gap 33 is defined between the first locating section 32 and the housing 2. The first and second gaps 30, 33 communicate with the receiving space 222.

The first assembling member 5 is passed through the first through hole 31 and the first fixing hole 101. The first assembling member 5 has a first engagement section 50 clamped between the first frame body 3 and the first side 10 to form the first gap 30.

The second assembling members 6 are disposed on inner side of the housing 2. Each second assembling member 6 has a second engagement section 60 clamped between the first locating section 32 and the housing 2 to form the second gap 33.

Figure 2C:
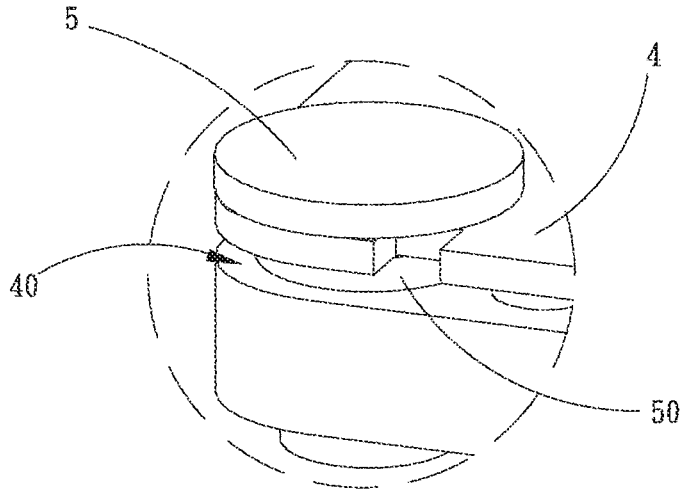
FIG. 2C is an enlarged view of circled area 2C of FIG. 2A.
Figure 3C:
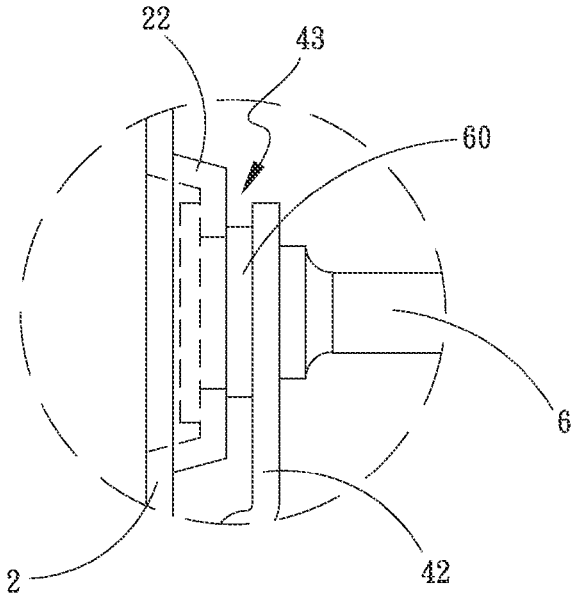
FIG. 3C is an enlarged view of circled area 3C of FIG. 3A.

Please further refer to FIGS. 2C and 3C. The fan vibration absorption structure of the present invention further includes a second frame body 4. The first and second frame bodies 3, 4 are made of metal material. The second frame body 4 is disposed on the second side 11 of the fan set 1 without contacting the second side 11. A third gap 40 is defined between the second frame body 4 and the second side 11 of the fan set 1.

The second frame body 4 has multiple second through holes 41 corresponding to the second fixing holes 111. The second frame body 4 further has multiple second locating sections 42 protruding from the second frame body 4 in a direction away from the second side 11 of the fan set 1. The second locating sections 42 correspond to the housing 2 without contacting the housing 2. Each second locating section 42 has a third perforation 424. A fourth gap 43 is defined between the second locating section 42 and the housing 2. The third and fourth gaps 40, 43 communicate with the receiving space 222.

The first assembling member 5 is passed through the second through hole 41 and the second fixing hole 111. The first engagement section 50 is clamped between the second frame body 4 and the second side 11 to form the third gap 40.

The second engagement section 60 of the second assembling member 6 is clamped between the second locating section 42 and the housing 2 to form the fourth gap 43.

Please further refer to FIGS. 1A and 1B. At least one raised section 22 is disposed on the inner side of the housing 2. The raised section 22 is correspondingly positioned in the second gap 33 and the fourth gap 43. The second assembling member 6 is assembled with the raised section 22. The raised section 22 is formed with a locating hole 221. The second assembling member 6 is passed through the locating hole 221, the second and fourth gaps 33, 43 and the first and third perforations 324, 423.

According to the above fan vibration absorption structure, the first assembling member 5 is passed through the first through hole 31 and the first fixing hole 101. The first engagement section 50 of the first assembling member 5 is clamped between the first frame body 3 and the first side 10 to form the first gap 30. Also, the first assembling member 5 is passed through the second through hole 41 and the second fixing hole 111. The first engagement section 50 is clamped between the second frame body 4 and the second side 11 to form the third gap 40. Cooperatively, the second engagement section 60 is clamped between the first locating section 32 and the housing 2 to form the second gap 33 and the second engagement section 60 is clamped between the second locating section 42 and the housing 2 to form the fourth gap 43. The first and second frame bodies 3, 4 are not in contact with the first and second sides 10, 11 of the fan set and the first and second locating sections 32, 42 are not in contact with the housing 2 to form the first, second, third and fourth gaps 30, 33, 40, 43. Accordingly, the vibration of the fan set 1 is prevented from being transmitted to the housing 2. Therefore, the vibration absorption effect is greatly enhanced and the assembling process is facilitated.

Figure 4A:
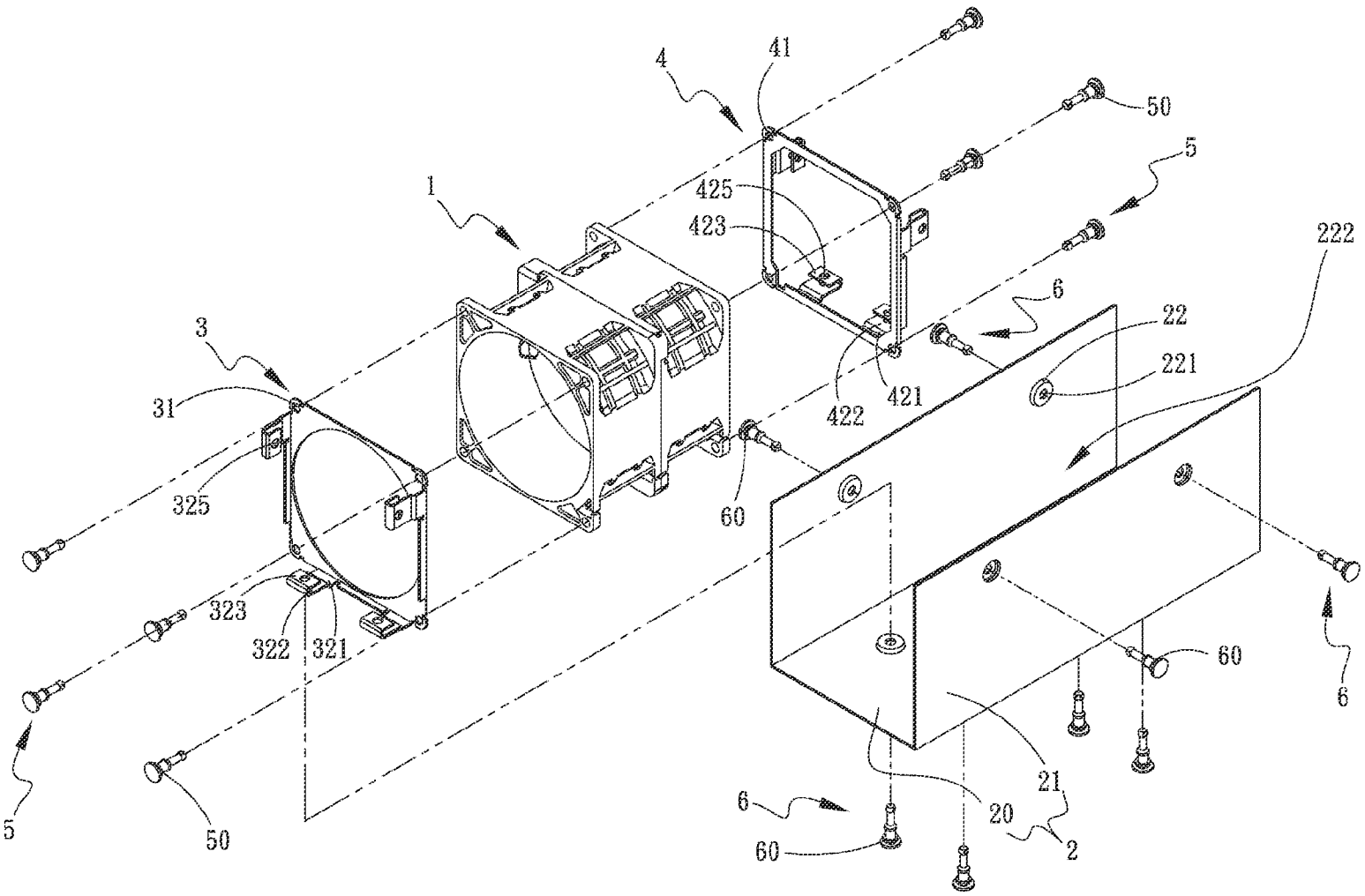
FIG. 4A is a perspective exploded view of a second embodiment of the fan vibration absorption structure of the present invention.
Figure 4B:
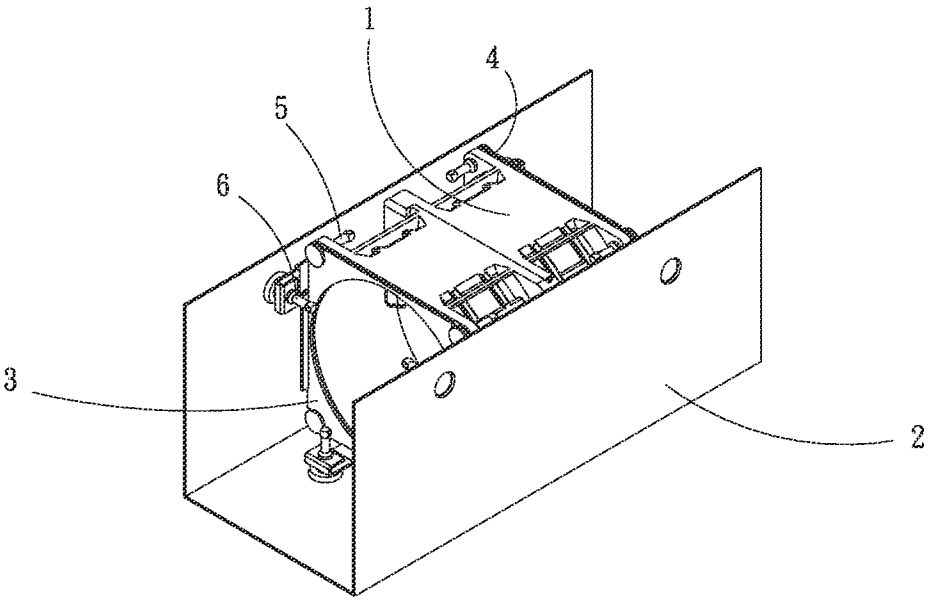
FIG. 4B is a perspective assembled view of the second embodiment of the fan vibration absorption structure of the present invention.

Please now refer to FIGS. 4A and 4B. FIG. 4A is a perspective exploded view of a second embodiment of the fan vibration absorption structure of the present invention. FIG. 4B is a perspective assembled view of the second embodiment of the fan vibration absorption structure of the present invention. Also referring to FIG. 1A, the second embodiment is partially identical to the first embodiment in component and connection relationship between the components and thus will not be repeatedly described hereinafter. The second embodiment is mainly different from the first embodiment in that the first locating section 32 is bent to form a first locating segment 321 and a second locating segment 322. The second locating section 42 is bent to form a third locating segment 421 and a fourth locating segment 422. The first and third locating segments 321, 421 are adjacent to the inner side of the housing 2. The second engagement section 60 is clamped between the second and fourth locating segments 322, 422 and the housing 2 to form the second and fourth gaps 33, 43.

A first bent segment 323 further extends from the second locating segment 322 in a direction to the frame body. The second locating segment 322 is connected with the first bent segment 323 to form a U-shaped configuration. The first bent segment 323 is formed with a second perforation 325 corresponding to the first perforation 324. The second assembling member 6 is passed through the first and second perforations 324, 325.

A second bent segment 423 further extends from the third locating segment 421 in a direction to the frame body. The fourth locating segment 422 is connected with the second bent segment 423 to form a U-shaped configuration. The second bent segment 423 is formed with a fourth perforation 425 corresponding to the third perforation 424. The second assembling member 6 is passed through the third and fourth perforations 424, 425.

By means of the above arrangement, the first and second frame bodies 3, 4 and the housing 2 can be more securely connected with each other. In addition, the vibration absorption effect is enhanced and the assembling process is facilitated.

Figure 5A:
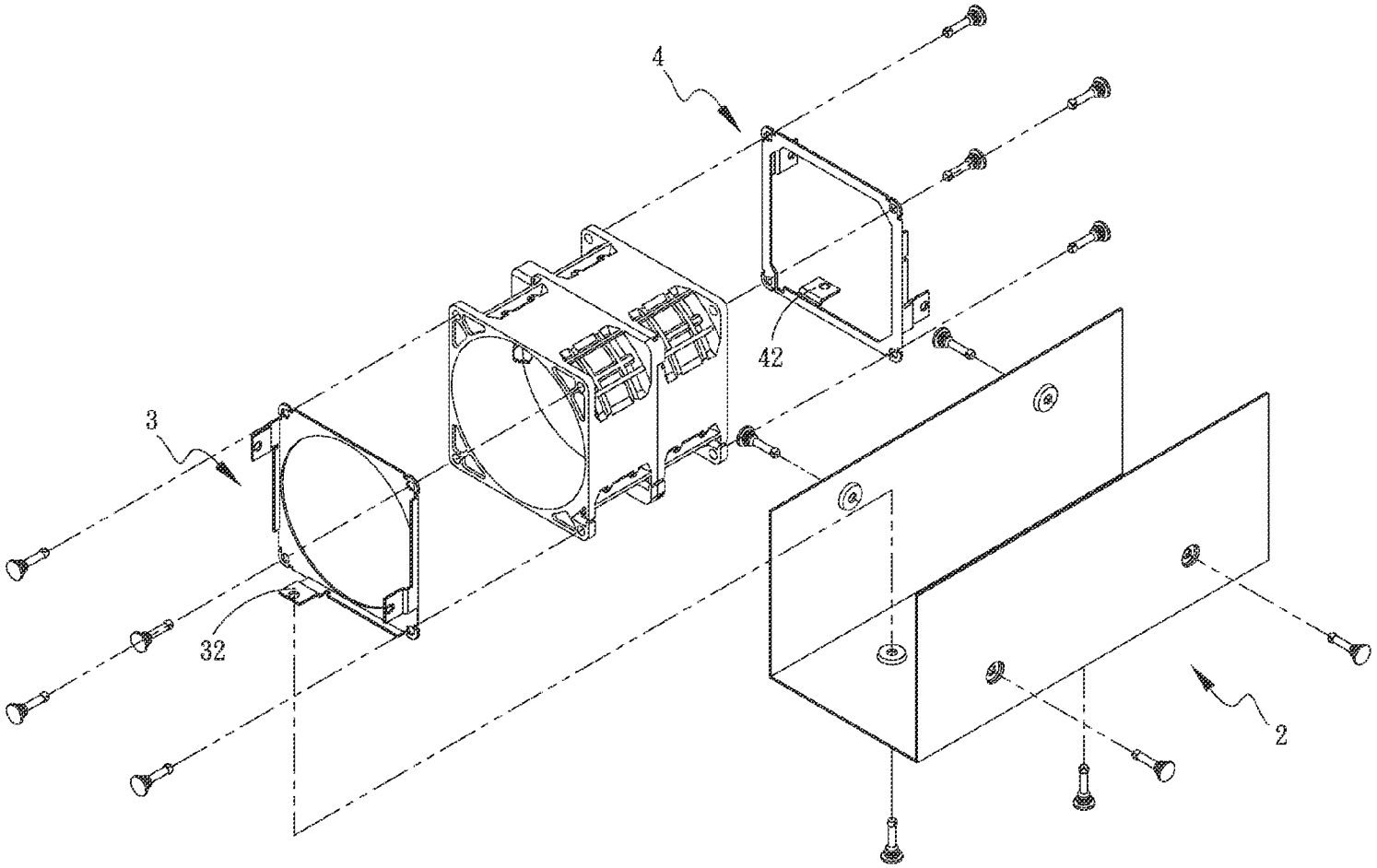
FIG. 5A is a perspective exploded view of a third embodiment of the fan vibration absorption structure of the present invention.
Figure 5B:
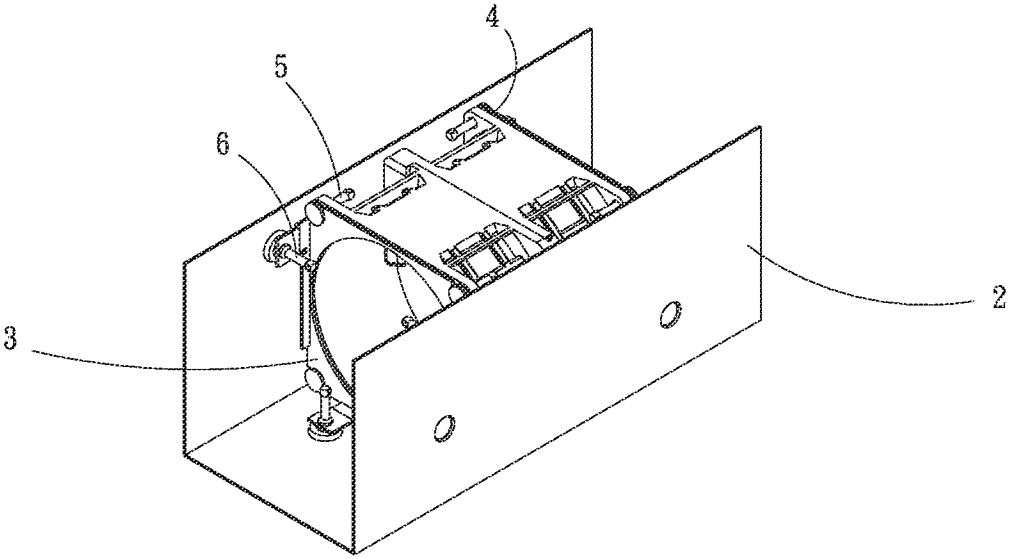
FIG. 5B is a perspective assembled view of the third embodiment of the fan vibration absorption structure of the present invention.

Please now refer to FIGS. 5A and 5B. FIG. 5A is a perspective exploded view of a third embodiment of the fan vibration absorption structure of the present invention. FIG. 5B is a perspective assembled view of the third embodiment of the fan vibration absorption structure of the present invention. The third embodiment is partially identical to the first embodiment in component and connection relationship between the components and thus will not be repeatedly described hereinafter. The third embodiment is mainly different from the first embodiment in that the first locating sections 32 of the first frame body 3 are asymmetrically arranged without contacting the housing 2 and the second locating sections 42 of the second frame body 4 are asymmetrically arranged without contacting the housing 2. By means of the above arrangement, the vibration absorption effect is also enhanced and the assembling process is facilitated.

In conclusion, in comparison with the conventional technique, the present invention has the following advantages:

1. Better vibration absorption effect is achieved.
2. The assembling process is facilitated.

The present invention has been described with the above embodiments thereof and it is understood that many changes and modifications in the above embodiments can be carried out without departing from the scope and the spirit of the invention that is intended to be limited only by the appended claims.

What is claimed is:

1. A fan vibration absorption structure applied to a fan set having a first side and a second side opposite to the first side, the first side having multiple first fixing holes, while the second side having multiple second fixing holes, the fan vibration absorption structure comprising:

a housing having a bottom board and two sidewalls disposed on two opposite sides of the bottom board, the bottom board and the sidewalls together defining a receiving space for receiving the fan set;

a first frame body disposed on the first side of the fan set without contacting the first side, first gaps being defined between the first frame body and the first side, the first frame body having multiple first through holes corresponding to the first fixing holes, the first frame body further having multiple first locating sections protruding from the first frame body in a direction away from the first side of the fan set, the first locating sections corresponding to the housing without contacting the housing, each first locating section having a first perforation, second gaps being defined between respective first locating sections and the housing, the first and second gaps communicating with the receiving space;

multiple first assembling members passed through the first through holes and the first fixing holes, respectively, each first gap is formed by a first engagement section of each first assembling member being clamped between the first frame body and the first side; and multiple second assembling members disposed on an inner side of the housing, and each second gap is formed by a second engagement section of each assembling member being clamped between a respective first location section and the housing.

2. The fan vibration absorption structure as claimed in claim 1, wherein raised sections are disposed on the inner side of the housing, each second gap being occupied by a respective raised section, and each second assembling member being assembled with a respective raised section.

3. The fan vibration absorption structure as claimed in claim 2, wherein each raised section is formed with a locating hole, at least one of the second assembling members being passed through a corresponding locating hole, second gap and first perforation.

4. The fan vibration absorption structure as claimed in claim 3, further comprising a second frame body, the second frame body being disposed on the second side of the fan set without contacting the second side, third gaps being defined between the second frame body and the second side, the second frame body having multiple second through holes corresponding to the second fixing holes, and further having multiple second locating sections protruding in a direction away from the second side of the fan set, the second locating sections corresponding to the housing without contacting the housing, each second locating section having a third perforation, a fourth gap being defined between respective second locating sections and the housing, the third and fourth gaps communicating with the receiving space.

5. The fan vibration absorption structure as claimed in claim 4, wherein a first assembling member is passed through a corresponding second through hole and second fixing hole, and each third gap is formed by a corresponding first engagement section being clamped between the second frame body and the second side.

6. The fan vibration absorption structure as claimed in claim 4, wherein each fourth gap is formed by a respective second engagement section of a corresponding second assembling member being clamped between a corresponding second locating section and the housing.

7. The fan vibration absorption structure as claimed in claim 4, wherein each fourth gap includes a respective raised section positioned therein.

8. The fan vibration absorption structure as claimed in claim 7, wherein at least one of the second assembling members is passed through a corresponding locating hole, fourth gap and third perforation.

9. The fan vibration absorption structure as claimed in claim 4, wherein each second locating section is bent to form a third locating segment and a fourth locating segment, each third locating segment being adjacent to the inner side of the housing, and each fourth gap is formed by a respective second engagement section being clamped between a corresponding fourth locating segment and the housing.

10. The fan vibration absorption structure as claimed in claim 9, wherein a second bent segment further extends from each third locating segment in a direction towards the second frame body, each second bent segment being formed with a fourth perforation corresponding to a respective third perforation, at least one of the second assembling members being passed through respective third and fourth perforations.

11. The fan vibration absorption structure as claimed in claim 10, wherein each fourth locating segment is connected with a corresponding second bent segment to form a U-shaped configuration.

12. The fan vibration absorption structure as claimed in claim 4, wherein the second locating sections of the second frame body are asymmetrically arranged without contacting the housing.

13. The fan vibration absorption structure as claimed in claim 4, wherein the first and second frame bodies are made of metal material.

14. The fan vibration absorption structure as claimed in claim 1, wherein each first locating section is bent to form a first locating segment and a second locating segment, each first locating segment being adjacent to the inner side of the housing, each second engagement section being clamped between the respective second locating segment and the housing to form the respective second gap.

15. The fan vibration absorption structure as claimed in claim 8, wherein a first bent segment further extends from each second locating segment in a direction towards the first frame body, each first bent segment being formed with a second perforation corresponding to a respective first perforation, each second assembling member being passed through first and second perforations.

16. The fan vibration absorption structure as claimed in claim 15, wherein each second locating segment is connected with a corresponding first bent segment to form a U-shaped configuration.

17. The fan vibration absorption structure as claimed in claim 1, wherein the first locating sections of the first frame body are asymmetrically arranged without contacting the housing.

18. The fan vibration absorption structure as claimed in claim 1, wherein the first and second assembling members are made of thermoplastic elastomer material.

* * * * *